US007481626B2

(12) United States Patent
Gajewski

(10) Patent No.: US 7,481,626 B2
(45) Date of Patent: Jan. 27, 2009

(54) CEILING FAN WITH INTEGRATED FAN BLADES AND HOUSING

(75) Inventor: Mark Gajewski, Avila Beach, CA (US)

(73) Assignee: Minka Lighting, Inc., Corona, CA (US)

( * ) Notice: Subject to any disclaimer, the term of this patent is extended or adjusted under 35 U.S.C. 154(b) by 75 days.

(21) Appl. No.: 11/272,195

(22) Filed: Nov. 10, 2005

(65) Prior Publication Data

US 2007/0104583 A1 May 10, 2007

(51) Int. Cl.
*F04D 29/34* (2006.01)

(52) U.S. Cl. ..... 416/220 A; 416/5; 416/204 R

(58) Field of Classification Search ..... 416/5, 416/214 R, 234, 220 A, 204 R, 205, 207
See application file for complete search history.

(56) References Cited

U.S. PATENT DOCUMENTS 5,330,323 A * 7/1994 Swanson ..... 416/219 A
6,039,541 A 3/2000 Parker et al.
6,059,531 A * 5/2000 Tai ..... 416/220 A
6,250,885 B1 * 6/2001 Gajewski ..... 416/214 R
D484,964 S 1/2004 Young
6,719,532 B2 4/2004 Bird
6,733,241 B2 5/2004 Bird

OTHER PUBLICATIONS

U.S. Appl. No. 29/232,332, Mark Gajewski.
U.S. Appl. No. 29/232,388, Mark Gajewski.
U.S. Appl. No. 29/232,343, Mark Gajewski.
U.S. Appl. No. 29/232,386, Mark Gajewski.
U.S. Appl. No. 29/232,385, Mark Gajewski.
Hampton Bay Internet Catalog, Florentine IV, Model # AC299-BN, printed from www.homedepot.com on May 31, 2005.
Hampton Bay Internet Catalog, Windward II, Model # 55295, printed from www.homedepot.com on May 31, 2005.
Emerson Catalog, Petal, Model # CF850, Jan. 1997; pp. 14-15, Emerson Electric Company; U.S.A.

* cited by examiner

*Primary Examiner*—Thomas E Denion
*Assistant Examiner*—Dwayne J White
(74) *Attorney, Agent, or Firm*—Baker & McKenzie LLP

(57) ABSTRACT

The invention relates generally to fans, and in particular to ceiling fans. A ceiling fan is suspended by a down rod and a motor that rotates relative to the down rod. The motor also has a connector mechanism. The fan has a fan blade with an attachment member, capable of being interconnected to the connector mechanism. A mechanism secures the attachment member to the connector mechanism.

13 Claims, 3 Drawing Sheets

17
22a
22b
22a
16
18a
18b
24a
24b
28
28
24b
17

17
24a
26
26
26
24b
26
26
26

17
18a
22a
16
18b
22b
24b
17
28
28
28
22a
24a

CEILING FAN WITH INTEGRATED FAN BLADES AND HOUSING

PRIOR RELATED APPLICATIONS

Not applicable.

FEDERALLY SPONSORED RESEARCH STATEMENT

Not applicable.

REFERENCE TO MICROFICHE APPENDIX

Not applicable.

FIELD OF THE INVENTION

The invention is directed to a ceiling fan. The invention is further directed to a ceiling fan blade attachment mechanism.

BACKGROUND OF THE INVENTION

A typical ceiling fan includes a down rod assembly suspended from the ceiling with a motor shaft which is connected to a lower portion of the down rod assembly. A motor body rotates about the motor shaft. A motor housing which surrounds the motor may be secured to either the motor shaft or the down rod assembly, which remain stationary. Blade mounting arms, also referred to as blade irons, are connected to the motor body and extend out of an opening of the motor housing or below the motor housing. A hub is attached to the motor shaft below the fan blades and blade irons.

A conventional ceiling fan blade typically consists of a solid unitary member of wood, metal or plastic, or a frame with a covering made of nylon or some other suitable material. In both cases, however, the blade is usually attached to the fan motor by means of a standardized mounting structure commonly referred to as the blade iron. The prior art provides numerous examples of fan blades that are attached to the fan motor with the aid of a blade iron. In a typical ceiling fan, the fan blade must first be attached to the blade iron, which in turn must be attached to the motor housing.

Conventional blade irons used in the art tend to be discrete structures that are separable from the fan blades and the fan housing. Typically, conventional blade irons are connected to their respective fan blades via their distal ends and are connected to the fan motor or motor housing via their proximal ends. Conventional blade irons are often decorative in nature and are used primarily to enhance the overall appearance of the ceiling fan rather than in a utilitarian role. In other words, the specific structural design of conventional blade irons are not always critical to the operational ability of ceiling fans.

The use of a conventional blade iron to attach a fan blade to a fan motor can add to the cost of the fan's manufacture and make it more expensive for purchase by a consumer. In addition, the presence of a blade iron can add to the weight of a fan, and thereby make it less efficient from an energy consumption standpoint. Additionally, it is a common commercial practice for ceiling fans to be shipped to the end user in an unassembled state. Therefore, a ceiling fan requires assembly prior to installation. This often challenging task can be made easier if the ceiling fan blades are capable of being easily connected to the rest of the ceiling fan unit.

Accordingly, it would be desirable to have a ceiling fan blade attachment mechanism where the ceiling fan blades are capable of being connected to a fan motor by a mechanism that is easy and convenient to the consumer. It would also be desirable to have a ceiling fan blade attachment mechanism that provides an easy and convenient way to assemble and disassemble fan blades from the motor.

SUMMARY OF THE INVENTION

An embodiment of the invention is a ceiling fan suspended by a down rod. The fan has a motor that rotates relative to the down rod and the motor has a connector mechanism. The fan has a fan blade with an attachment member capable of being interconnected to the connector mechanism. A mechanism secures the attachment member to the connector mechanism. The connector mechanism has a plurality of studs that facilitate proper positioning of the attachment member. In one embodiment, the plurality of studs is located on an upper portion of the motor. In another embodiment, the plurality of studs is located on a lower portion of the motor. In another embodiment, the plurality of studs is located on both an upper portion of the motor and a lower portion of the motor. The attachment member is not separable from the fan blade. The attachment member has a plurality of apertures. The mechanism for securing the attachment member to the connector mechanism is one or more screws. The screws are inserted through apertures in the connector mechanism.

Another embodiment of the invention is a fan with a motor having a motor shaft and a motor body that rotates relative to the motor shaft. A connector member, a plurality of studs, connects to the motor body. The fan also includes a fan blade having a plurality of apertures sized and positioned to interlock with the studs and a mechanism, one or more screws, for securing the fan blade to the motor body. The screws are inserted through apertures present in the connector member.

Another embodiment of the invention is a method of installing a fan blade. The method includes inserting the fan blade having a plurality of apertures with a connector member having a plurality of studs. The connector member is connected to a motor and the plurality of apertures aligns with the plurality of studs. The fan blade are attached to the motor by an attachment mechanism.

In another embodiment of the invention, a ceiling fan has a motor and a plurality of fan blades. The motor has a motor shaft and a plurality of connector mechanisms. Each blade is secured to the motor via an attachment mechanism and the attachment mechanism connects to the connector mechanisms. The attachment mechanism may be one or more screws. The ceiling fan may also include a light source.

In another embodiment of the invention, a method of installing a fan blade includes providing a fan blade having an attachment member and a fan motor having a connector mechanism. The attachment member and the connector mechanism are interlocked and the fan blade is secured to the motor by an attachment mechanism.

BRIEF DESCRIPTION OF THE DRAWINGS

The accompanying drawings, which are incorporated in and constitute a part of this specification, exemplify the invention and together with the description, serve to explain the principles of the invention.

DESCRIPTION OF EMBODIMENTS OF THE INVENTION

Reference will now be made in detail to embodiments of the invention, an example of which is illustrated in the accompanying drawings.

Figure 1:
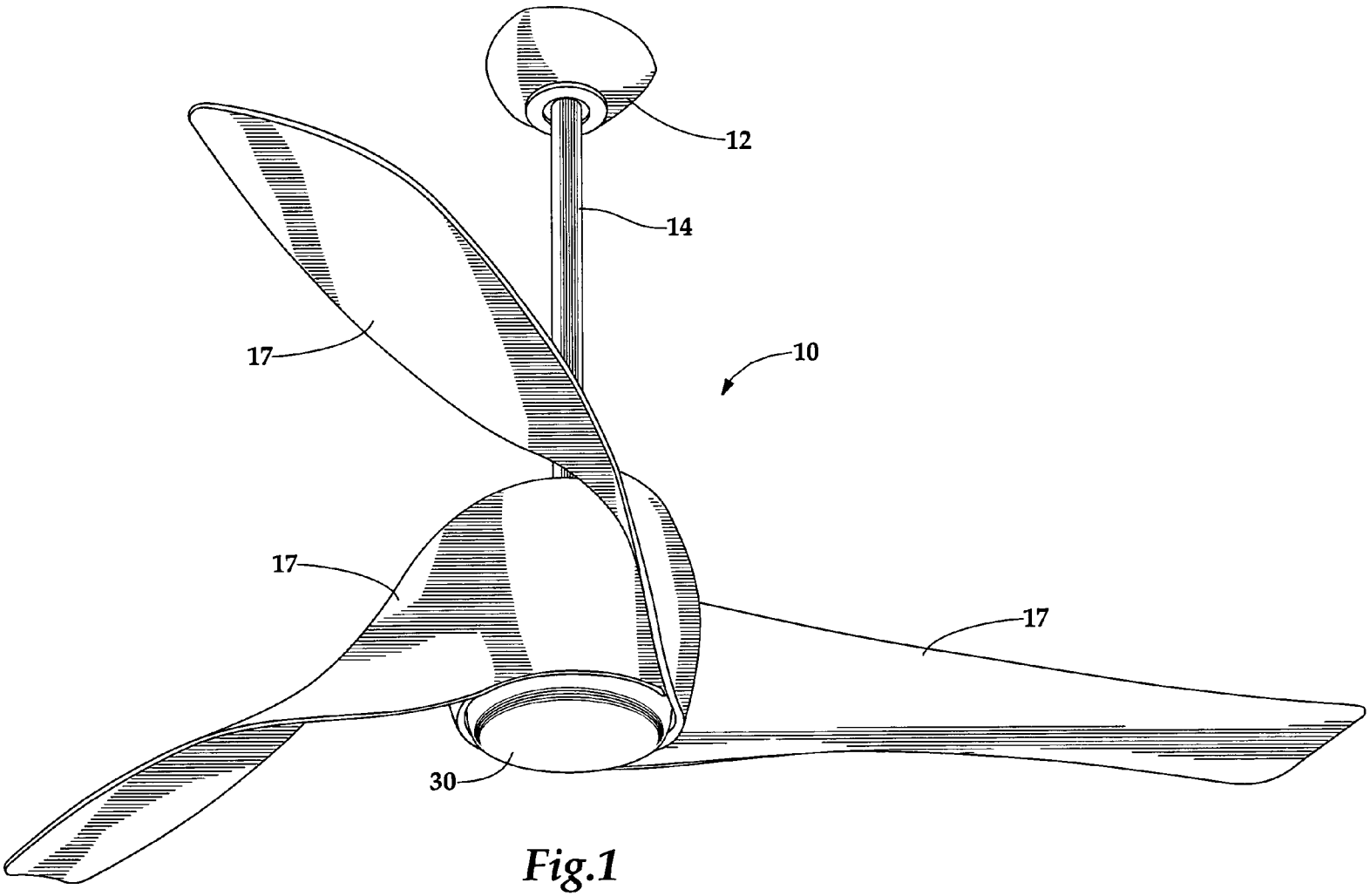
FIG. 1 shows a perspective view from below of an embodiment of the invention.
Figure 2:
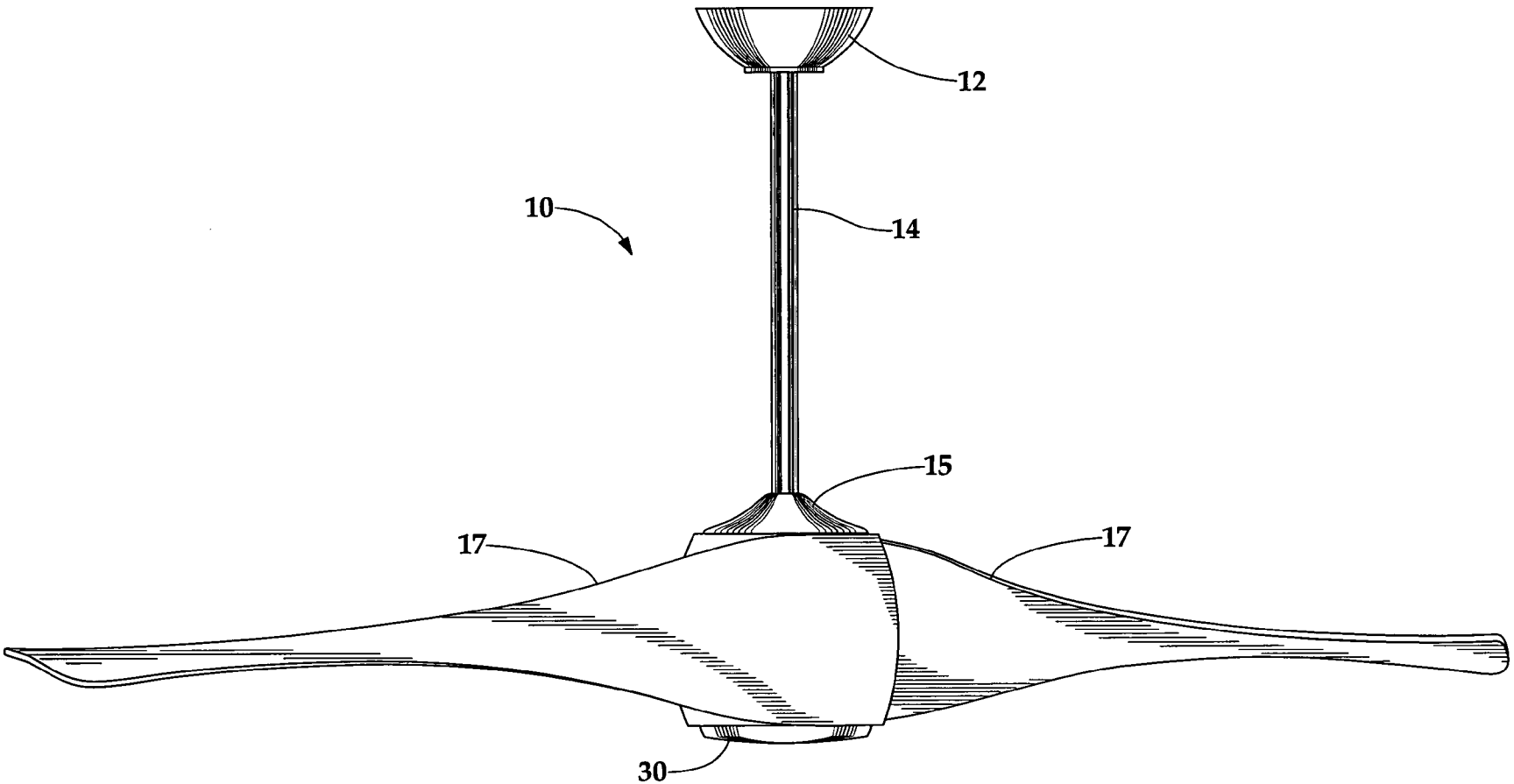
FIG. 2 shows an elevation view of the embodiment of the invention in FIG. 1.
Figures 3, 4, 5:
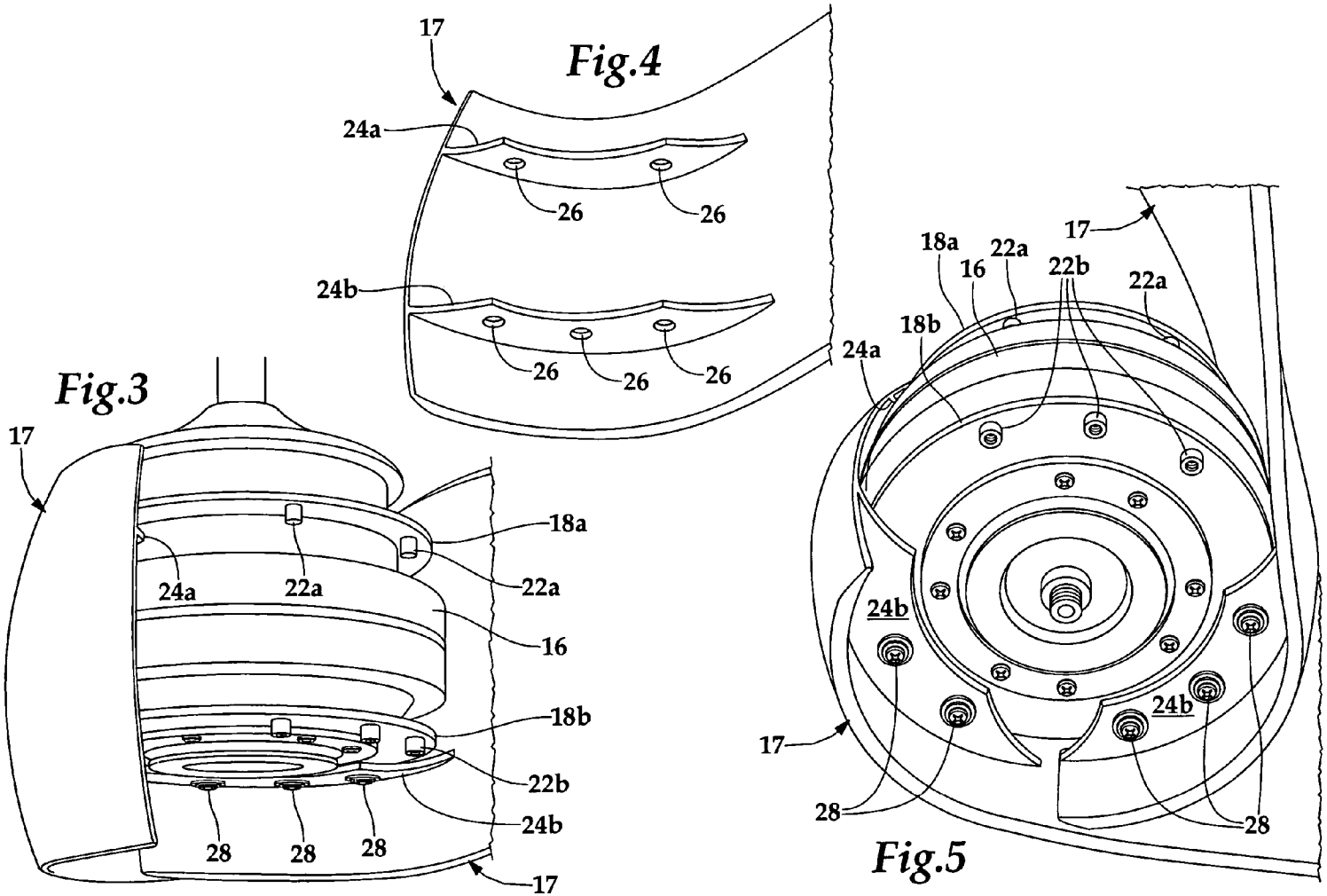
FIG. 3 shows an enlarged elevation view of the embodiment in FIG. 1 with a fan blade removed to illustrate the motor.
FIG. 4 shows an enlarged perspective view of the inside of the fan blade of the embodiment in FIG. 1.
FIG. 5 shows an enlarged perspective view of the bottom of the motor of the embodiment in FIG. 1.

Referring first to FIGS. 1 and 2, the ceiling fan 10 is connected to a down rod assembly 14 that is suspended from the ceiling via a ceiling mount 12. A housing cap 15 is stationary and is typically connected to the down rod 14. A motor 16, shown in FIG.3, is connected to the down rod 14 via the housing cap 15 and rotates relative to the down rod 14 when the ceiling fan 10 is in operation. The ceiling fan 10 includes one or more fan blades 17.

Referring now to FIG. 3, the motor 16 comprises one or more connector mechanisms 18. For convenience, a plurality of connector mechanisms will be designated by reference number 18. In a preferred embodiment, there is a first connector mechanism 18*a* and a second connector mechanism 18*b*. The plurality of connector mechanisms 18 include a plate having a plurality of studs 22 that facilitate proper positioning of the fan blades 17. For convenience, a plurality of studs will be designated by reference number 22; 22*a* designating studs extending from plate 18*a* and 22*b* designating studs extending from plate 18*b*. Although proper positioning of the fan blades 17 is illustrated as being done by studs, other methods of positioning the fan blades are contemplated as being included in the present invention, and include without limitation, screws, posts, columns, hook and pile fasteners, mechanical fasteners, and the like.

Referring now to FIG. 4, a plurality of fan blades will be designated by reference number 17. The plurality of fan blades 17 each include one or more attachment members 24 that facilitate the attachment of the fan blades to the motor 16. For convenience, a plurality of attachment members will be designated by reference number 24. In certain embodiments of the invention, there is a first attachment member 24*a* contiguous with, i.e., not separable from, the rest of the fan blade structure and a second attachment member 24*b* contiguous with the rest of the fan blade structure. The attachment members 24 include one or more apertures 26 for receiving the studs 22 of the connector mechanisms 18 on the motor 16. Although the attachment members 24 are illustrated as apertures to facilitate the attachment of the fan blades to the motor, other methods to facilitate the attachment of the fan blades to the motor are contemplated as being included in the present invention, and include without limitation, apertures, studs, screws, hook and pile fasteners, mechanical fasteners, and the like.

As illustrated in FIG. 5, the attachment of the fan blades 17 to the motor 16 is facilitated by aligning the apertures 26 of the first attachment member 24*a* with the studs 22*a* of the first connector mechanism 18*a* and aligning the apertures 26 of the second attachment member 24*b* with the studs 22*b* of the second connector mechanism 18*b*. Studs 22*b* may be hollow with threaded interiors. The fan blade 17 is connected to the motor 16 via one or more attachment mechanisms 28. In certain embodiments of the invention, the attachment mechanism is one or more screws 28, where the screws are inserted through apertures in the studs 22 of the connector mechanism 18 to connect the attachment member 24 to the motor as shown in FIG. 5. In certain embodiments, the attachment mechanism may connect the first attachment member 24*a* to the motor, the second attachment member 24*b*, or both. Although the attachment member 24 is illustrated as being secured to the motor 16 by screws, other methods of securing the attachment member to the motor are contemplated as being included in the present invention, and include without limitation, screws, hook and pile fasteners, adhesive, rivets, mechanical fasteners, and the like. In certain embodiments of the invention, the plurality of fan blades 17 may be secured to the motor 16 by additional or alternative mechanisms.

As illustrated in FIGS. 3-5, connector mechanism 18 includes a flange extending substantially horizontally around all of a part of the outer surface of the motor 16. Extending from the flange are a plurality of substantially tubular studs 22. As further illustrated in FIGS. 3-5, the attachment members 24 include a flange extending substantially horizontally from an interior surface of the fan blade. Attachment members 24 include apertures 26 sized and positioned so as to be interlockable with studs 22 on connector mechanism 18. In other embodiments of the invention, connector mechanism 18 may include an inwardly extending slot on the motor 16. In such embodiments, attachment members 24 would be sized to fit within such slots. In other embodiments, studs 22 may have any of a variety of other shapes, including for example, rectangular. In such embodiments, apertures 26 are shaped and sized to interconnect or interlock with studs 22. Alternatively, connector mechanism 18 could comprise a shaped flange with no studs 22. In such embodiments, attachment members 24 would be complementarily shaped so as to provide proper placement of the fan blades.

In some embodiments, the ceiling fan 10 is further coupled to a light source 30. Typically the light source 30 is electrically powered. Such a device may be generally referred to as an electrical device. An electrical device is defined herein as a device powered by alternating current or direct current, for example, or any other conventional electrical power source. The light source 30 is connected in a fixed manner to the motor 16, i.e., not rotating relative to the motor. In certain embodiments, the light source 30 is mounted to and rotatably fixed to the motor 16. Furthermore, not all embodiments of the fan 10 comprise a light source 30. In some embodiments, the light source 30 is removable and a removable cap (not shown) can be connected in place of the light source 30 to the motor 16.

While the invention has been described with reference to one or more particular embodiments, those skilled in the art will recognize that many modifications may be made thereto without departing from the spirit and scope of the invention. Each of these embodiments, and obvious variations thereof, is contemplated as falling within the spirit and scope of the claimed invention, which is set forth in the following claims.

What is claimed is:

1. A ceiling fan suspended by a down rod, the fan comprising:

a motor that rotates relative to the down rod, the motor having a substantially tubular connector mechanism;

a fan blade, wherein the fan blade comprises an attachment member, wherein the attachment member is capable of being interconnected to the connector mechanism; and a mechanism for securing the attachment member to the connector mechanism, wherein the attachment member comprises a substantially horizontal flange contiguous with the fan blade and is not separable from the fan blade.

2. The fan of claim 1, wherein the connector mechanism comprises a plurality of studs that facilitate proper positioning of the attachment member.

3. The fan of claim 2, wherein the plurality of studs is located on an upper portion of the motor.

4. The fan of claim 2, wherein the plurality of studs is located on a lower portion of the motor.

5. The fan of claim 2, wherein the plurality of studs is located on both an upper portion of the motor and a lower portion of the motor.

6. The fan of claim 1, wherein the attachment member comprises a plurality of apertures.

7. The fan of claim 1, wherein the mechanism for securing the attachment member to the connector mechanism comprises one or more screws.

8. The fan of claim 7, wherein the one or more screws are inserted through apertures present in the connector mechanism.

9. The ceiling fan of claim 1, further comprising a light source.

10. A fan comprising:

a motor having a motor shaft and a motor body that rotates relative to the motor shaft;

a connector member connected to the motor body, wherein the connector member comprises a plurality of substantially tubular studs;

a fan blade having a substantially horizontal flange contiguous with the fan blade and is not separable from the fan blade, the flange having a plurality of apertures sized and positioned to interlock with the studs; and a mechanism for securing the fan blade to the motor body.

11. The fan of claim 10, wherein the mechanism for securing the fan blade comprises one or more screws.

12. The fan of claim 11, wherein the one or more screws are inserted through apertures present in the connector member.

13. A method of installing a fan blade, the method comprising:

providing a fan blade having an attachment member comprising a substantially horizontal flange continuous with the fan blade;

providing a fan motor having a substantially tubular connector mechanism;

interlocking the attachment member and the connector mechanism; and securing the fan blade to the motor by an attachment mechanism, wherein the attachment member is not separable from the fan blade.

* * * * *